US007784612B2

(12) United States Patent
Kanda et al.

(10) Patent No.: US 7,784,612 B2
(45) Date of Patent: Aug. 31, 2010

(54) PACKAGING CONTAINER FOR ACUPUNCTURE NEEDLES

(75) Inventors: Zensho Kanda, Shizuoka (JP); Yusuke Kikuchi, Shizuoka (JP)

(73) Assignee: Seirin Corporation, Shizuoka (JP)

( * ) Notice: Subject to any disclaimer, the term of this patent is extended or adjusted under 35 U.S.C. 154(b) by 0 days.

(21) Appl. No.: 12/633,184

(22) Filed: Dec. 8, 2009

(65) Prior Publication Data

US 2010/0089784 A1 Apr. 15, 2010

Related U.S. Application Data

(63) Continuation of application No. PCT/JP2007/061639, filed on Jun. 8, 2007.

(51) Int. Cl.
*B65D 85/28* (2006.01)

(52) U.S. Cl. ..... 206/380; 206/438; 206/363; 206/469; 206/370; 206/820; 383/20

(58) Field of Classification Search ..... 206/469, 206/531, 532, 538, 820, 380, 381, 443, 362, 206/210, 439, 484.1, 363, 370; 383/37, 207, 383/210

See application file for complete search history.

(56) References Cited

U.S. PATENT DOCUMENTS

| | | | | |
|---|---|---|---|---|
| 2,892,538 | A * | 6/1959 | Middleton, Jr. et al. | 206/366 |
| 3,921,805 | A * | 11/1975 | Compere | 206/532 |
| 4,011,949 | A * | 3/1977 | Braber et al. | 206/532 |
| RE29,705 | E * | 7/1978 | Compere | 206/531 |
| 5,325,968 | A * | 7/1994 | Sowden | 206/532 |
| 5,551,567 | A * | 9/1996 | Malone et al. | 206/469 |
| 5,758,774 | A * | 6/1998 | Leblong | 206/531 |
| 6,338,407 | B2 * | 1/2002 | Danville | 206/532 |
| 6,352,158 | B1 * | 3/2002 | Cole-Bennett et al. | 206/532 |
| 2008/0011627 | A1 | 1/2008 | Tanbo | |

FOREIGN PATENT DOCUMENTS

| | | | |
|---|---|---|---|
| EP | 0107241 | B1 | 5/1984 |
| JP | 89060 | C2 | 8/1930 |
| JP | 4-71790 | B2 | 11/1992 |
| JP | 5-4834 | Y2 | 2/1993 |
| JP | 6-31740 | U | 4/1994 |
| JP | 6-44429 | Y2 | 11/1994 |
| WO | WO 9407761 | A1 * | 4/1994 |
| WO | 2006075623 | A1 | 7/2006 |

* cited by examiner

*Primary Examiner*—David T Fidei
(74) *Attorney, Agent, or Firm*—Baker & Hostetler LLP

(57) ABSTRACT

A packaging container for acupuncture needles capable of storing a plurality of acupuncture needles is provided. The packaging container (storage containers) in which the acupuncture needles to be used are stored can be opened at one time, according to the number of acupuncture needles to be used. On one end portion side of a packaging container (blister package) including a container body and a sheet member detachably attached to a planar surface of the container body, a free portion in which the sheet member is not attached to an outer frame portion of the container body, is disposed. Further, perforated lines (cut portions and uncut portions) are disposed along center lines of boundary portions from one end portion of the packaging container to the other end portion thereof. Here, the length of the uncut portion on the free portion is made longer than the length of each uncut portion on a portion other than the free portion.

6 Claims, 12 Drawing Sheets

PACKAGING CONTAINER FOR ACUPUNCTURE NEEDLES

CROSS-REFERENCE TO RELATED APPLICATIONS

This application is a Continuation of International patent application PCT/JP2007/061639, filed on Jun. 8, 2007, the disclosure of which is incorporated herein by reference in its entirety.

TECHNICAL FIELD

The present invention relates to a packaging container (storage containers) for acupuncture needles to be used for the acupuncture.

BACKGROUND ART

Acupuncture needles to be used for the acupuncture are provided one by one in individually packaged (for example, blister packaged) for safety, on the assumption that the individual packages are opened one by one to be used.

Such an individual package is available for a user (practitioner) who uses one acupuncture needle at one time, but requires a user who uses many acupuncture needles to take trouble in opening the individual packages one by one.

Therefore, as disclosed in Patent Literature 1, there is also a packaging presentation in which many acupuncture needles (for example, 10 needles) are not individually packaged but are stored in one container.

Patent Literature 1: Japanese Laid-Open (Kokai) Utility Model Application Publication No. H06 (1994)-031740.

However, for example in the 10 needles package, in the case where only some needles in the 10 needles package are used, it is not possible to preserve the remaining acupuncture needles in a sterile condition, and thus, there is a problem of insanitation.

SUMMARY OF THE INVENTION

Therefore, in view of the above conventional problems, the present invention has an object to provide a packaging container (storage containers) which is capable of storing a plurality of acupuncture needles, and also, according to the number of acupuncture needles to be used, the storage containers in which the acupuncture needles to be used are stored, can be opened in one lump at one time.

In order to achieve the above-mentioned object, a packaging container for acupuncture needles according to the present invention includes: a container body in which a plurality of storage grooves for individually storing a plurality of acupuncture needles are formed in concave on a planar surface of the container body so as to be arranged in parallel with each other, and boundary portions between the storage grooves are held to be flat with an outer frame portion of the container body; and a single sheet member which is detachably attached to the outer frame portion of the container body and to the boundary portions thereof in a state where the acupuncture needles are stored in the plurality of storage grooves of the container body, to cover opening portions of the plurality of storage grooves of the container body.

Further, a free portion which is not attached to the outer frame portion of the container body is formed on one end portion side of the sheet member, viewed from a longitudinal direction of the storage grooves.

Furthermore, perforated lines each including cut portions and uncut portions are formed along center lines of the boundary portions from one end portions of the container body and of the sheet member to the other end portions thereof, viewed from the longitudinal direction of the storage grooves.

Still further, the length of the uncut portion of each perforated line formed on the free portion is made longer than the length of each uncut portion thereof formed on a portion other than the free portion.

According to the present invention, in the case where only some of the plurality of acupuncture needles are used, storage containers in which the acupuncture needles to be used are stored are separated along the perforated line formed along the center line of the boundary portion. After that, the sheet member is removed from the free portion of the separated storage containers, so that it is possible to open the separated storage containers in which the acupuncture needles to be used are stored, in one lump at one time, and also, to maintain a package state of the remaining acupuncture needles which are not to be used.

Further, in the case where the plurality of acupuncture needles is all used, the sheet member is removed from the free portion of the packaging container to thereby open the packaging container in which the acupuncture needles to be used (all of the acupuncture needles) are stored, in one lump at one time.

DESCRIPTION OF EMBODIMENTS

An embodiment of the present invention will be described hereunder, referring to the accompanying drawings.

Figure 1:
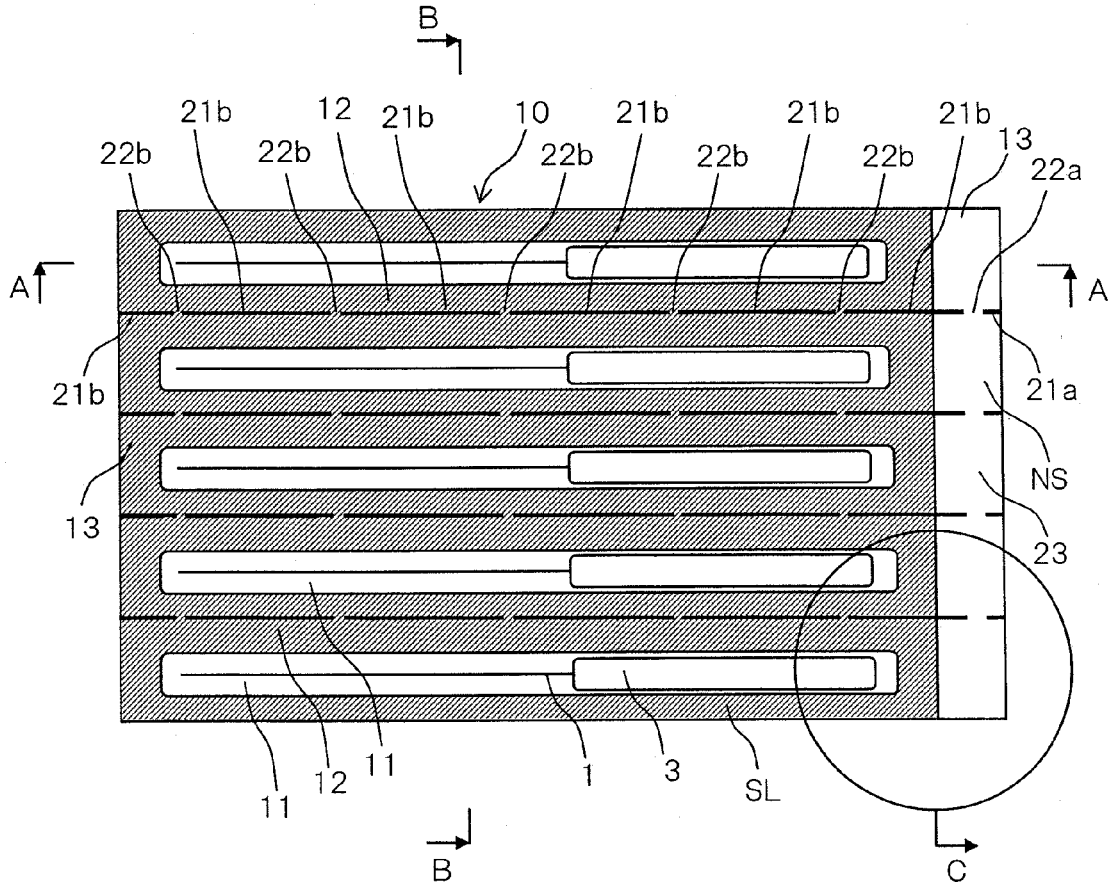
FIG. 1 is a plan view of a packaging container (container body) illustrating one embodiment of the present invention.
Figure 2:
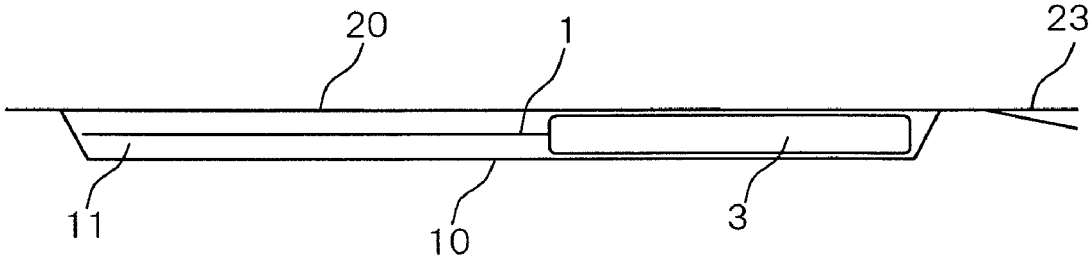
FIG. 2 is a cross-sectional view along A-A line of FIG. 1.
Figure 3:
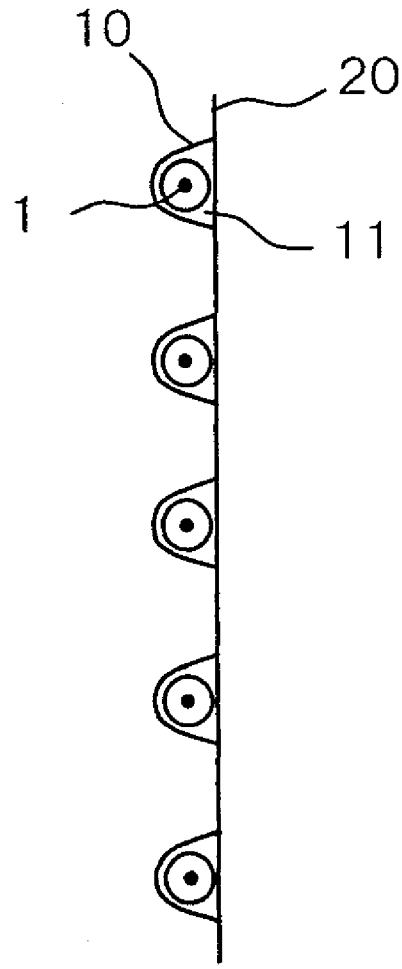
FIG. 3 is a cross-sectional view along B-B line of FIG. 1.
Figure 4:
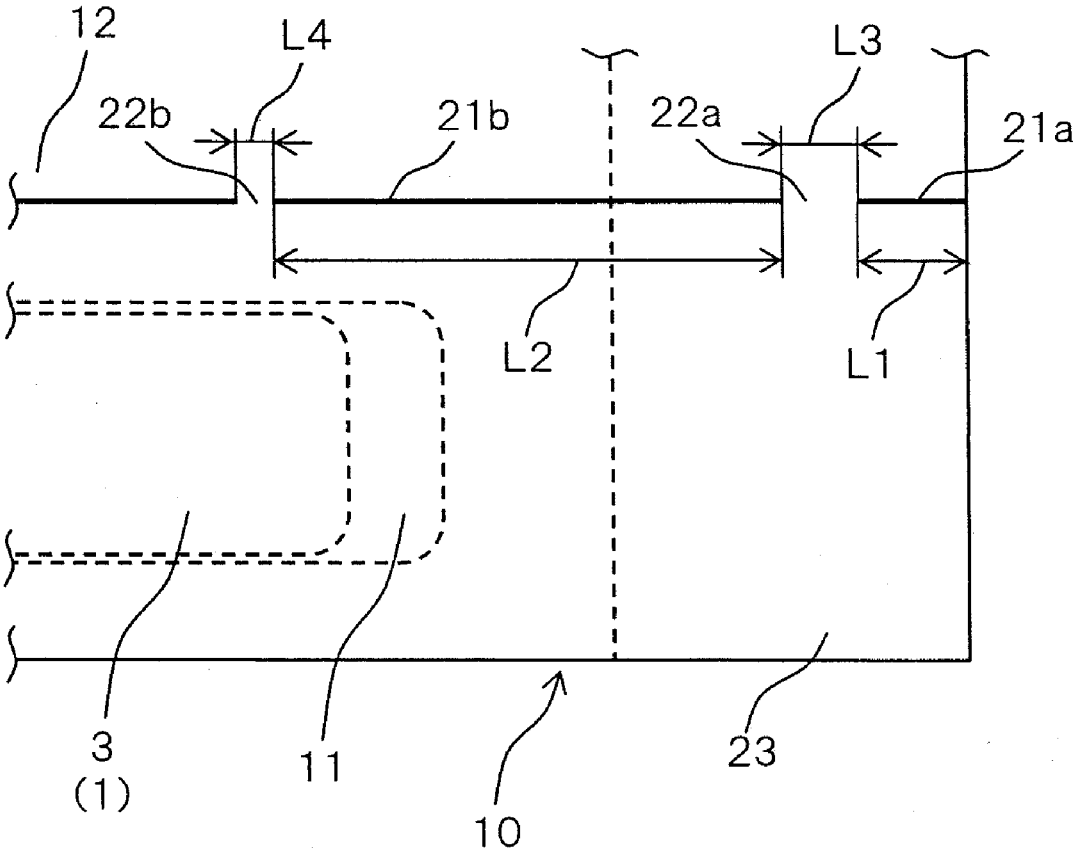
FIG. 4 is an enlarged view in C portion of FIG. 1.
Figure 5:
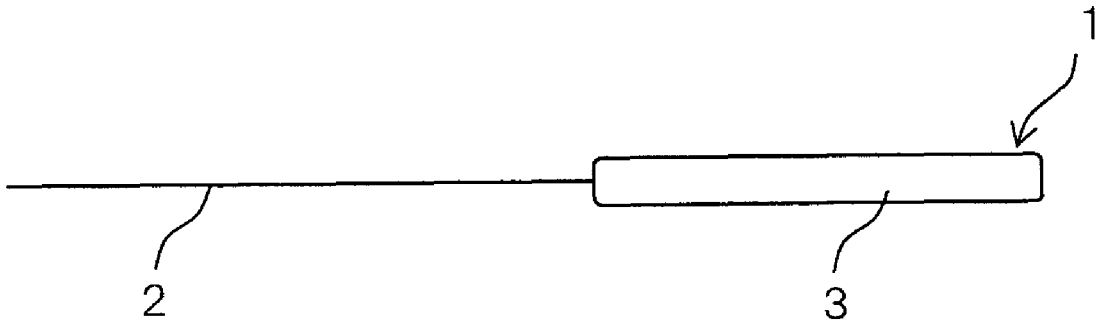
FIG. 5 is a schematic diagram for explaining an acupuncture needle.

FIG. 1 is a plan view of a packaging container (container body) illustrating one embodiment of the present invention; FIG. 2 is a cross-sectional view along A-A line of FIG. 1; FIG. 3 is a cross-sectional view along B-B line of FIG. 1; FIG. 4 is an enlarged view in C portion of FIG. 1; FIG. 5 is a schematic diagram of an acupuncture needle; and FIG. 6 is a schematic diagram of an acupuncture needle in a needle guide tube.

As illustrated in FIG. 5, an acupuncture needle 1 includes: a metallic needle body 2 having a needlepoint at a tip end portion thereof; and a resin-made or metallic needle handle 3 disposed on a base end portion of the metallic needle body 2.

Figure 6:
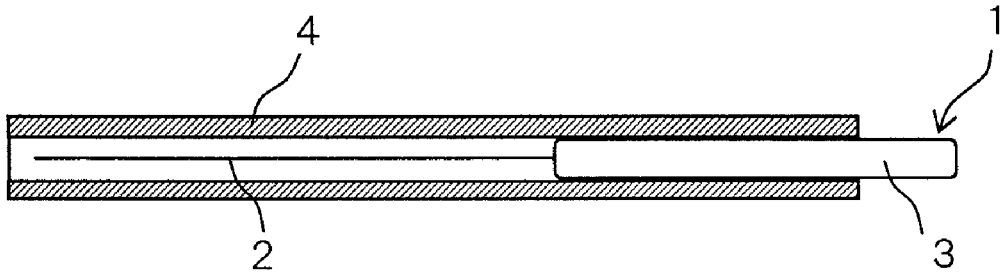
FIG. 6 is a schematic diagram for explaining an acupuncture needle in a needle guide tube.

Further, as illustrated in FIG. 6, the acupuncture needle 1 may be inserted into a cylindrical needle guide tube 4.

In order to store a plurality of acupuncture needles 1 (for example, five acupuncture needles) in one lump, the packaging container (storage containers) according to the present invention is adopted.

The packaging container according to the present invention includes a container body (bottom member) 10 and a sheet member (top member) 20.

The container body 10 is resin-made, and a plurality of storage grooves 11 for individually storing the plurality of acupuncture needles 1 are formed in concave on a rectangular planar surface of the container body 10 so as to be arranged in parallel with each other, and boundary portions 12 between the storage grooves 11 are held to be flat with an outer frame portion 13 of the container body 10.

The acupuncture needles 1 are individually stored in the plurality of storage grooves 11 of the container body 10, and thereafter, an opening portion of the container body 10 is sealed with the sheet member 20.

The sheet member 20, which is permeable to sterilizing gas, is constructed of one rectangular paper material of which size is approximately same as the size of planar portion of the container body 10. The sheet member 20 is detachably attached to the outer frame portion 13 of the container body 10 and to the boundary portions 12 thereof, to cover opening portions of the storage grooves 11 of the container body 10.

This attachment is performed by heat sealing, and a hatched portion SL in FIG. 1 is an attached portion (sealed portion).

Further, there is an un-hatched portion NS outside the hatched portion (sealed portion) SL in FIG. 1, and this un-hatched portion NS is an unsealed portion. As apparent from this, a free portion 23 which is not attached to the outer frame portion 13 is disposed on one end portion side of the sheet member 20, viewed from a longitudinal direction of the storage grooves 11, so that the free portion 23 is readily pinched by fingers when the sheet member 20 is detached. In this case, the sheet member 20 (or at least a part thereof) may be made larger than the planar portion of the container body 10, to thereby pinch a portion protruding from the outer frame portion 13. Incidentally, in the present embodiment, the free portion 23 is disposed on the side of the needle handle of the acupuncture needle 1 stored in the storage groove 11. Otherwise, in the case where the acupuncture needle 1 in the needle guide tube 4 is used, the free portion 23 may be disposed on the needle tip side of the acupuncture needle 1 stored in the storage groove 11.

Here, by bearing an indication by which a site on which the free portion 23 is disposed can be recognized on an outer surface of the sheet member 20, it is possible for a user to readily recognize the site on which the free portion 23 is disposed to thereby readily open the packaging container (storage containers).

Further, perforated lines including cut portions 21*a*, 21*b* and uncut portions 22*a*, 22*b* are disposed along center lines of the boundary portions 12 from one end portion of the sheet member 20 to the other end portion thereof, viewed from the longitudinal direction of the storage grooves 11. Incidentally, in the present embodiment, the perforated lines (the cut portions 21*a*, 21*b* and the uncut portions 22*a*, 22*b*) are disposed not only on the sheet member 20 but also on the container body 10. Further, the perforated lines are formed by means of a press-cutting blade after the sheet member 20 is attached to the container body 10, but the method of forming perforated lines is not limited thereto.

Here, there will be described the details of the perforated lines (the cut portions 21*a*, 21*b* and the uncut portions 22*a*, 22*b*) with reference to FIG. 4.

FIG. 4 is an enlarged view in C-portion of FIG. 1.

The cut portion 21*a* of each perforated line is disposed on an outer edge portion of the free portion 23, and the length L1 thereof is shorter than the length L2 of each cut portion 21*b* thereof disposed on a portion other than the outer edge portion of the free portion 23. Further, the uncut portion 22*a* of each perforated line is disposed on the free portion 23, and the length L3 thereof is longer than the length L4 of each uncut portion 22*b* thereof disposed on a portion other than the free portion 23.

Next, there will be described opening methods of the packaging container according to the present invention with reference to FIG. 7 to FIG. 12.

Figure 7:
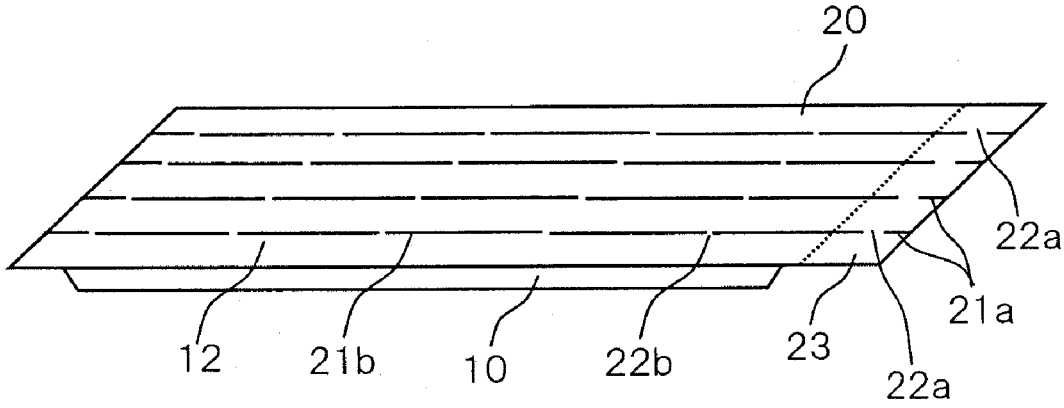
FIG. 7 is a perspective view of the packaging container storing five acupuncture needles.
Figure 8:
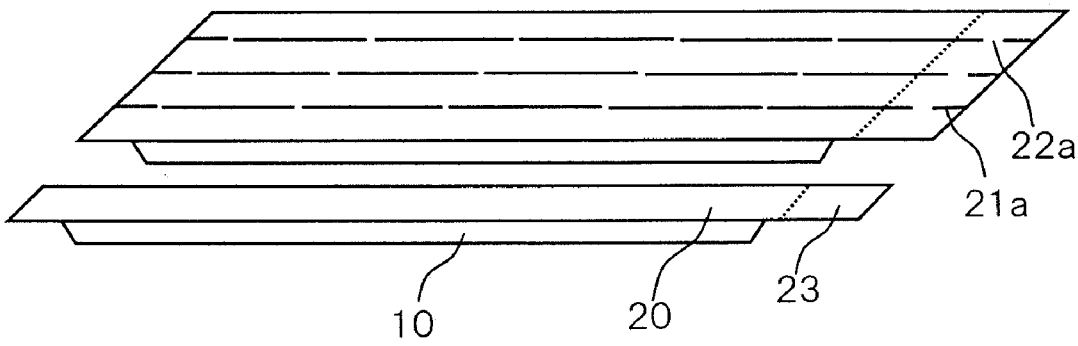
FIG. 8 is a perspective view illustrating an opening method of when only one acupuncture needle is used.
Figure 9:
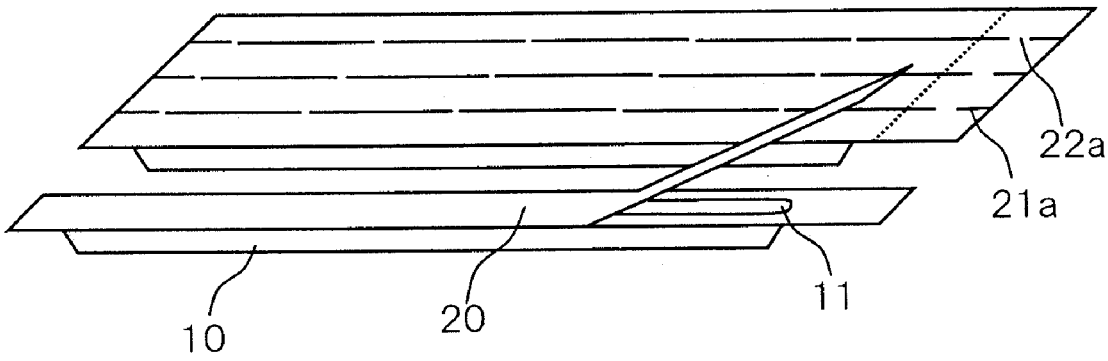
FIG. 9 is a perspective view illustrating the opening method of when only one acupuncture needle is used.

FIG. 7 to FIG. 9 illustrate an opening method of when only one acupuncture needle 1 in five acupuncture needles 1 stored in the packaging container is used.

Firstly, the storage container storing one acupuncture needle 1 to be used is separated (refer to FIG. 8) from the packaging container storing five acupuncture needles 1 (refer to FIG. 7) along the perforated lines (the cut portions 21*a*, 21*b* and the uncut portions 22*a*, 22*b*) disposed along the center line of the boundary portion 12. At this time, when only the longer uncut portion 22*a* is cut off, each uncut portion 22*b* can also be readily cut off.

Next, the free portion 23 of the storage container storing one acupuncture needle 1 is pinched by fingers, so that the sheet member 20 is detached (refer to FIG. 9).

Figure 10:
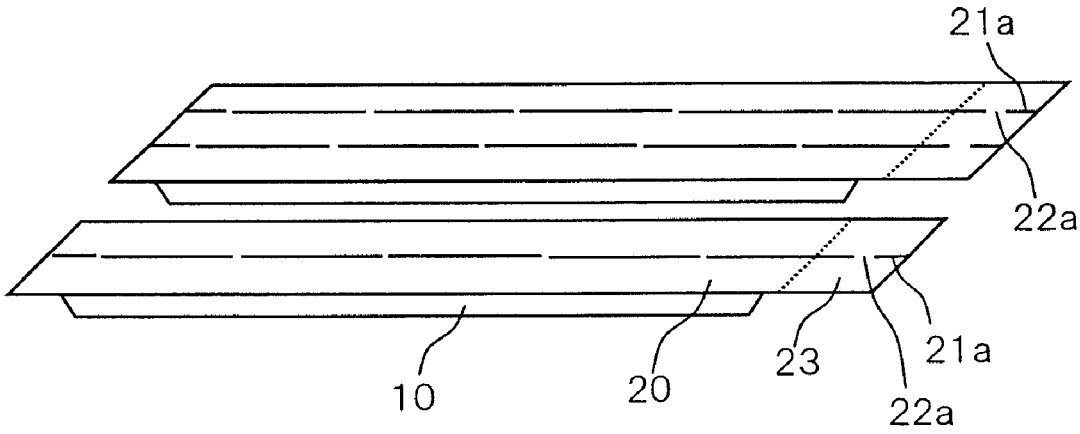
FIG. 10 is a perspective view illustrating an opening method of when two acupuncture needles are used.
Figure 11:
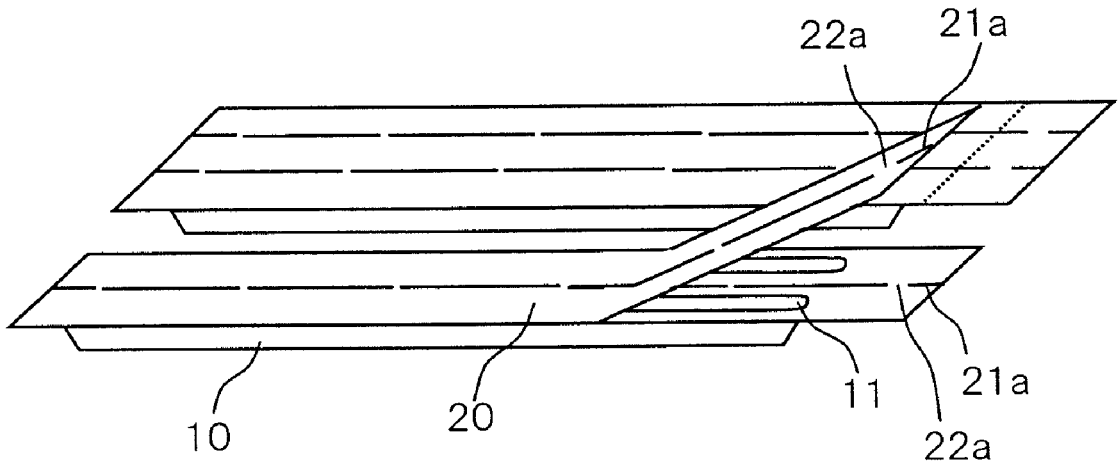
FIG. 11 is a perspective view illustrating the opening method of when two acupuncture needles are used.

FIG. 7, FIG. 10 and FIG. 11 illustrate an opening method of when two acupuncture needles 1 in five acupuncture needles 1 stored in the packaging container are used.

Firstly, the storage containers storing two acupuncture needles 1 to be used are separated (refer to FIG. 10) from the packaging container storing five acupuncture needles 1 (refer to FIG. 7) along the perforated lines (the cut portions 21*a*, 21*b* and the uncut portions 22*a*, 22*b*) disposed along the center line of the boundary portion 12.

Next, the free portion 23 of the storage containers storing two acupuncture needles 1 to be used is pinched by fingers, so that the sheet member 20 is detached at one time via the uncut portion 22*a* (refer to FIG. 11). At this time, the uncut portion 22*a* on the detaching side is longer than each uncut portion 22*b*, and therefore, it is easy to detach the sheet member 20 for the two (plural) acupuncture needles 1 at one time.

By using the opening methods illustrated in FIG. 7 to FIG. 11, the storage containers to be opened and the storage containers not to be opened can be separated from each other, and therefore, it is possible to maintain the acupuncture needles 1 stored in the storage containers not to be opened, to be in the packaged condition (sterile condition).

Figure 12:
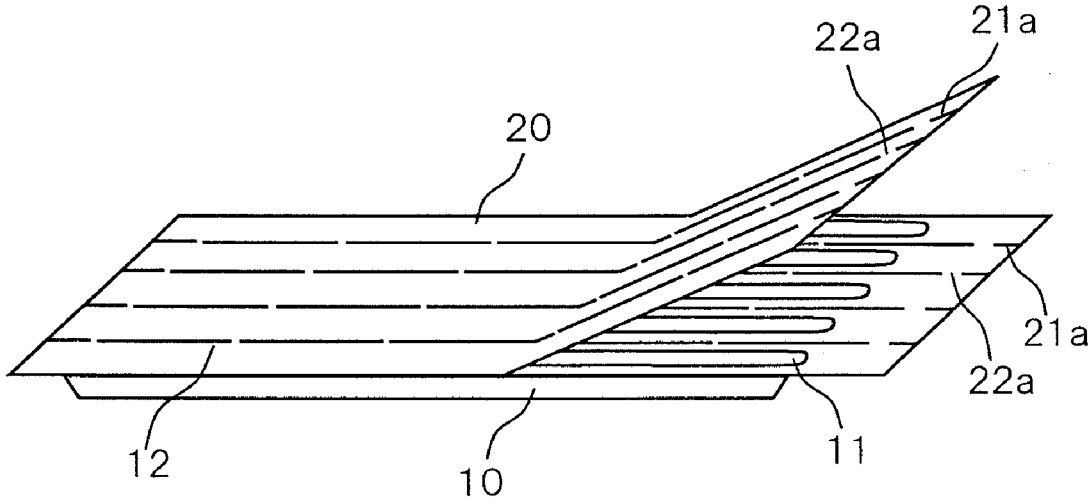
FIG. 12 is a perspective view illustrating an opening method of when five acupuncture needles are all used.

FIG. 7 and FIG. 12 illustrate an opening method of when five acupuncture needles 1 stored in the packaging container are all used.

The free portion 23 of the packaging container storing five acupuncture needles 1 (refer to FIG. 7) is pinched by fingers, so that the sheet member 20 is detached at one time via the uncut portion 22*a* (refer to FIG. 12).

According to the present embodiment, by forming the uncut portion 22*a* of each perforated line on the free portion 23, it is possible to pinch the free portion 23 by fingers for the purpose of taking out the plurality of acupuncture needles 1, to thereby detach the sheet member 20 via the uncut portion 22*a* of each perforated line formed on the free portion 23. Here, the uncut portion 22*a* of each perforated line is not limited to a singular number but may be plural numbers.

Further, according to the present embodiment, the length L3 of the uncut portion 22*a* of each perforated line formed on the free portion 23 is longer than the length L4 of each uncut portion 22*b* thereof formed on the portion other than the free portion 23. Therefore, when the free portion 23 is pinched by fingers for the purpose of taking out the plurality of acupuncture needles 1 so that the sheet member 20 is detached at one time via the uncut portion 22*a* of each perforated line formed on the free portion 23, it is possible to suppress the uncut portion 22*a* from splitting off from the cut portion 21*a* of each perforated line to be broken.

Furthermore, according to the present embodiment, the cut portion 21*a* or 21*b* of each perforated line is formed on at least one end portions of the container body 10 and of the sheet member 20, viewed from the longitudinal direction of the storage groove 11. Therefore, when the packaging container is separated along the center line of the boundary portion 12, it is possible to be readily separated from the cut portion 21*a* or 21*b* of each perforated line formed on the one end portions of the container body 10 and of the sheet member 20.

Still further, according to the present embodiment, the cut portion 21*a* of each perforated line is formed on the outer edge portion of the free portion 23 and the length L1 of this cut portion 21*a* of each perforated line is shorter than the length L2 of each cut portion 21*b* thereof formed on the portion other than the outer edge portion of the free portion 23. Therefore, when the free portion 23 is pinched by fingers for the purpose of taking out the plurality of acupuncture needles 1 so that the sheet member 20 is detached at one time via the uncut portion 22*a* of each perforated line formed on the free portion 23, it is possible to suppress the uncut portion 22*a* from splitting off from the cut portion 21*a* of each perforated line.

Even still further, according to the present invention, by forming the free portion 23 on the side of the needle handle 3 of the acupuncture needle 1 stored in the storage groove 11 of the container body 10, after the storage container is opened, it is possible to pinch the needle handle 3 (or the needle guide tube 4) by fingers to take out the acupuncture needle 1 without directly touching the needle body 2.

Moreover, according to the present embodiment, the sheet member 20 is permeable to the sterilizing gas. Therefore, the acupuncture needles 1 are stored in the container body 10 and the sheet member 20 is attached to the container body 10 so that the packaging container is sealed, and thereafter, the packaging container can be subjected to sterilizing process by being exposed to the sterilizing gas. Here, if another sterilizing process is performed, it is also possible to use a resin film or the like as the sheet member.

As described above, according to the number of acupuncture needles to be used, the storage containers storing the acupuncture needles to be used are opened in one lump at one time to thereby taken out the acupuncture needles to be used from the packaging container storing the plurality of acupuncture needles. Further, the remaining acupuncture needles not to be used can be maintained in the package state, and therefore, the industrial applicability of the present invention is large.

What is claimed is:

1. A packaging container for acupuncture needles, comprising:

a container body in which storage grooves for individually storing acupuncture needles are formed concavely on a planar surface of the container body so as to be arranged parallel with each other, and boundary portions between the storage grooves are held to be flat with an outer frame portion of the container body; and a single sheet member which is detachably attached to the outer frame portion of the container body and to the boundary portions thereof in a state in which the acupuncture needles are stored in the storage grooves of the container body, to cover opening portions of the storage grooves of the container body, wherein:

a free portion which is not attached to the outer frame portion of the container body is formed on one end portion side of the sheet member, viewed from a longitudinal direction of the storage grooves;

perforated lines, each comprising cut portions and uncut portions, are formed along center lines of the boundary portions from the one end portion side, including the free portion, of the container body and of the sheet member to the other end portion side thereof, viewed from the longitudinal direction of the storage grooves;

a length of each of the uncut portions of the respective perforated lines is made shorter than a length of one of the uncut portions thereof; and a length of one of the uncut portions of the respective perforated lines formed on the free portion is made longer than a length of each of the uncut portions thereof formed on a portion other than the free portion.

2. The packaging container according to claim 1, wherein one of the cut portions of the respective perforated line is formed on an outer edge portion of the free portion, and a length of one of the cut portions of the respective perforated lines formed on the outer edge portion of the free portion is shorter than a length of each of the cut portions thereof formed on a portion other than the outer edge portion of the free portion.

3. The packaging container according to claim 1, wherein one of the cut portions of the respective perforated lines is formed on at least one end portion of the container body and of the sheet member, viewed from the longitudinal direction of the storage groove.

4. The packaging container according to claim 3, wherein one of the cut portions of the respective perforated lines is formed on an outer edge portion of the free portion, and a length of one of the cut portions of the respective perforated lines formed on the outer edge portion of the free portion is shorter than a length of each of the cut portions thereof formed on a portion other than the outer edge portion of the free portion.

5. The packaging container according to claim 1, wherein the free portion is formed on a needle handle side of each of the acupuncture needles stored in the storage grooves of the container body.

6. The packaging container according to claim 1, wherein the sheet member is permeable to sterilizing gas.

* * * * *